United States Patent [19]

Heaton

[11] 4,449,488

[45] May 22, 1984

[54] FREE PISTON INTERNAL COMBUSTION ENGINE

[75] Inventor: William C. Heaton, Decatur, Ga.

[73] Assignee: Rondal P. Howell, Brewton, Ala. ; a part interest

[21] Appl. No.: 400,071

[22] Filed: Jul. 20, 1982

Related U.S. Application Data

[62] Division of Ser. No. 157,517, Jun. 9, 1980, Pat. No. 4,344,288.

[51] Int. Cl.[3] ..... F02B 71/00

[52] U.S. Cl. ..... 123/46 R; 123/62

[58] Field of Search ..... 123/46 R, 46 A, 46 B, 123/47 R, 61 R, 62

[56] References Cited

U.S. PATENT DOCUMENTS

| | | | |
|---|---|---|---|
| 528,105 | 10/1894 | Migliavacca | 123/62 |
| 855,256 | 5/1907 | Morey | 123/62 |
| 936,972 | 10/1909 | Wright | 123/61 R |
| 1,745,821 | 2/1930 | Gribojedoff | 123/62 X |

FOREIGN PATENT DOCUMENTS

| | | | |
|---|---|---|---|
| 386106 | 4/1908 | France | 60/595 |
| 789886 | 8/1935 | France | 123/62 |

*Primary Examiner*—Michael Koczo

*Attorney, Agent, or Firm*—Jones & Askew

[57] ABSTRACT

An internal combustion engine in which a rotor or turbine is driven by the exhaust gases of a pair of interconnected double-acting pistons. The double-acting pistons are interconnected by a pinion gear and are internally constructed to have an inner piston slidably reciprocating within a chamber defined within an outer piston. The purpose of the inner piston is to feed additional fuel into the main combustion chamber in a controlled manner. Exhaust gases are collected and washed before being exhausted to the atmosphere or recycled within the engine.

4 Claims, 6 Drawing Figures

FREE PISTON INTERNAL COMBUSTION ENGINE

CROSS REFERENCE TO RELATED APPLICATION

This application is a divisional application of Ser. No. 157,517, filed June 9, 1980, now U.S. Pat. No. 4,344,288, issued Aug. 17, 1982.

TECHNICAL FIELD

The present invention relates to internal combustion engines, and more particularly relates to an internal combustion engine utilizing the exhaust of interconnected double acting pistons to drive a turbine to provide rotary motive force.

BACKGROUND ART

In the most commonly used type of combustion engine, such as the standard automobile engine, the drive shaft is rotated by converting the thrust of pistons into rotational motion of the drive shaft by a direct mechanical linkage in the form of connecting rods. The manner of conversion of the chemical energy of the fuel used to drive the pistons into rotational energy of the drive shaft in such engines lacks efficiency because a significant amount of the energy imparted by the exploding fuel to the thrust of the pistons is lost to friction and to poor leverage through the mechanical linkage. Standard piston engines use relatively large amounts of fuel, and cause well known air and noise pollution problems.

Turbine engines have been designed with the object of providing more efficient power plants. In some turbine engines, a mixture of air and fuel is compressed and ignited, and the expanding combustion gases are directed through a turbine that is connected to a drive shaft. Compression of the air/fuel mixture can be accomplished by means of reciprocating pistons, as shown in U.S. Pat. No. 3,710,569, issued to Rinker. In another turbine engine, shown in U.S. Pat. No. 3,068,639, issued to Benoit, a double acting piston is utilized to provide combustion gases to drive a turbine, but the structure of the engine shown in U.S. Pat. No. 3,068,639 lacks dynamic balance.

SUMMARY OF THE INVENTION

The present invention provides an improved internal combustion engine in which a pair of semi-free floating double acting pistons are interconnected for reciprocal motion at the same speed in opposite directions, and the exhaust from both ends of both pistons is directed against a turbine that is in turn connected to a drive shaft. An engine embodying the invention operates with better fuel efficiency and exerts greater leverage on the drive shaft. Additional features of the invention permit recycling of unburned fuel, removal of pollutants from exhaust gases, and internal muffling of sound generated by operation of the engine.

Generally described, an internal combustion engine according to the present invention comprises a frame, a piston housing mounted on the frame, the piston housing defining a first cylinder and a second cylinder parallel to one another within the housing, a first double acting piston and a second double acting piston slidably positioned within the first and second cylinders, a means interconnecting the first and second pistons for limiting the sliding movement thereof within the first and second cylinders to reciprocation at the same speed in opposite directions, a turbine surrounding the cylinders and mounted on the frame for rotation about an axis at right angles to the plane of the cylinders, fuel injection means for directing fuel alternately to each end of each of the first and second cylinders, and ignition means for alternately igniting fuel at each end of each of the first and second cylinders, the housing defining exhaust openings therein alternately directing exhaust gases from each of the ends of each of the cylinders to impinge upon vanes of the turbine which is caused to rotate.

The means interconnecting the pistons preferably is a freely rotatable pinion gear positioned between the parallel pistons and engaging racks defined in the outer surface of each of the pistons. The engine can include a starting mechanism which includes a means for rotating the pinion gear through an arc alternately in opposite directions, the pistons being reciprocated in response to the alternating rotation of the pinion gear.

Each of the double acting pistons utilized in an engine embodying the invention preferably is of a novel design. Generally described, each piston apparatus includes a housing defining a primary piston chamber therein, a primary double acting piston slidably movable within the primary piston chamber and defining a secondary piston chamber therein, a secondary double acting piston slidably movable within the secondary piston chamber parallel to the movement of the primary piston, means for conducting vaporized fuel into the secondary piston chamber and compressing it with the secondary piston, internal injector means for conducting the pressurized fuel from the secondary piston chamber into the primary piston chamber, and means for igniting fuel in the primary piston chamber.

More particularly described, each piston preferably comprises a cylindrical housing defining a piston chamber and having a first end and a second end, the housing defining through its cylindrical wall a first vaporized fuel opening adjacent to the first end of the housing and a second vaporized fuel opening adjacent to the second end of the housing. An outer cylindrical piston also having a first end and a second end is fitted within the housing for reciprocal movement, the outer piston defining a first annular channel in its cylindrical surface, a first interior cylindrical cavity and a first passageway connecting the first annular channel to the first interior cavity. An inner cylindrical piston is fitted within the interior cavity of the outer piston for reciprocal movement, the inner piston defining a second interior cavity, a second annular channel in its cylindrical surface, a second passageway connecting the second annular channel to the second interior cavity, and a first valve for alternately providing a passageway between the second interior cavity and the first interior cavity at alternate ends of the inner piston. The first end of the outer piston defines a third passageway therein between the first interior cavity and the piston chamber adjacent to the first end of the housing, and the third passageway includes a second valve for permitting passage of vaporized fuel through the third passageway only toward the piston chamber. The second end of the outer piston defines a fourth passageway between the first interior cavity and the piston chamber adjacent to the second end of the housing, and the fourth passageway includes a third valve for permitting passage of vaporized fuel in the fourth passageway only toward the piston chamber. The first end of the housing defines a first exhaust opening therein including a fourth valve for selectively opening and closing the first exhaust opening, and the second end of the housing defines a second exhaust opening therein including a fifth valve for selectively opening and closing the second exhaust opening. Ignition means such as spark plugs are provided for selectably igniting vaporized fuel between the ends of the outer piston and the end of the housing toward which the piston is approaching. The first vaporized fuel opening in the housing communicates with the piston chamber between the first end of the outer piston and the first end of the housing and the second vaporized fuel opening communicates with the first annular channel in the outer piston when the outer piston moves toward the second end of the housing. The second vaporized fuel opening communicates with the piston chamber between the second end of the outer piston and the second end of the housing and the first vaporized fuel opening communicates with the first annular channel in the outer piston when the outer piston moves toward the first end of the housing. The first passageway defined by the outer piston communicates with the second annular channel of the inner piston. The housing can further include pockets opposite each end of the outer piston into which extensions extending from the ends of the outer piston can enter in close fitting relationship to cushion the termination of movement of the piston. The ignition means can be activated in response to changes in pressure within the piston chamber.

Thus, it is an object of the present invention to provide an internal combustion engine that is quiet, clean and more efficient than previous internal combustion engines.

It is a further object of the present invention to provide an internal combustion engine in which a drive shaft is rotated by a turbine that is driven by the exhaust gases from a pair of parallel, double acting pistons.

It is a further object of the present invention to provide dynamic balance in such an engine by providing a linkage between the parallel, double acting pistons.

It is a further object of the present invention to provide in such an engine a novel starting mechanism in which the linkage between the pistons is used to reciprocate the pistons during starting of the engine.

It is a further object of the present invention to provide a double acting, semi-free floating piston that includes an inner piston free floating within a semi-free floating outer piston, fuel being distributed through the inner piston into the piston chamber outside the outer piston, in order to extend the period of combustion for greater efficiency.

Other features, objects and advantages of the present invention will become apparent upon reading the following specification when taken in conjunction with the drawing and the appended claims.

DETAILED DESCRIPTION

Figure 1:
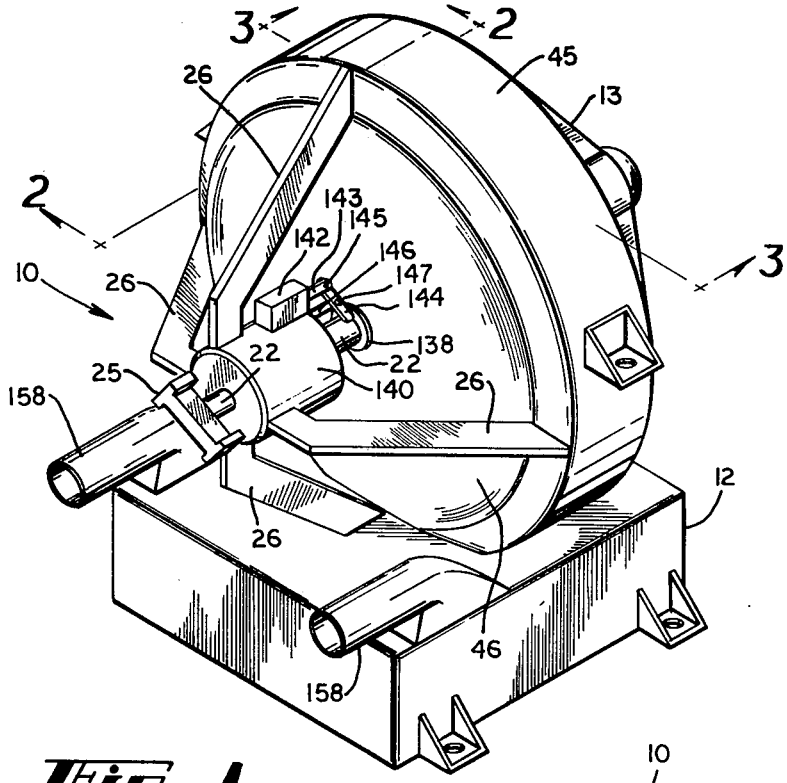
FIG. 1 is a rear pictorial view of an internal combustion engine embodying the present invention.
Figure 2:
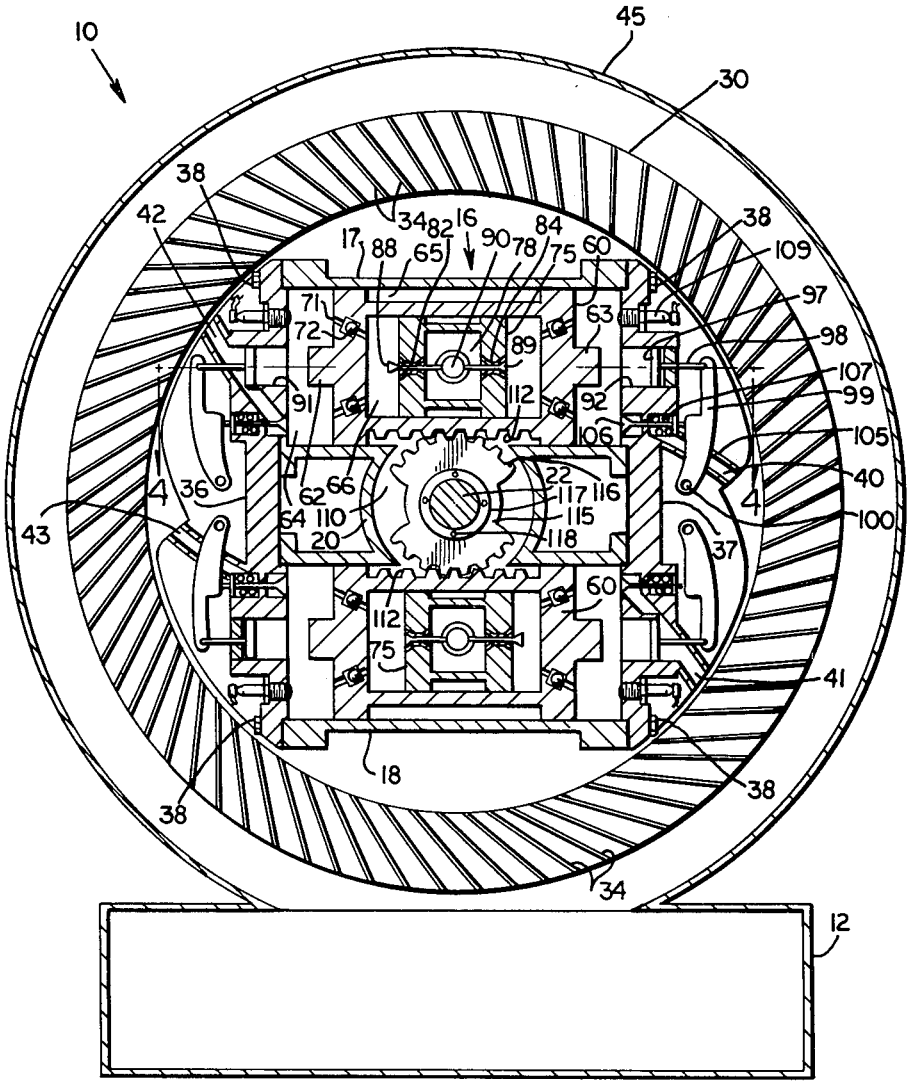
FIG. 2 is a rear vertical cross sectional view of the engine of FIG. 1, taken along line 3—3 of FIG. 1.

Referring now in more detail to the drawing, in which like numerals represent like parts throughout the several views, FIG. 1 shows a rear pictorial view of an internal combustion engine 10 embodying the present invention. Referring to FIG. 1 and FIG. 2, the engine 10 includes a hollow base 12 to which is attached an upwardly extending support member 13. A pair of intake manifolds, an upper intake manifold 14 and a lower intake manifold 15 are attached to the support member 13 approximately midway of its height, and extend toward the rear of the engine. An engine block 16 is suspended from the intake manifolds 14 and 15, and defines an upper cylinder 17 and a lower cylinder 18. Between the cylinders 17 and 18, the engine block 16 includes a central connecting portion 20 which defines a cylindrical drive shaft opening 21 which receives a drive shaft 22 for rotatable motion about the axis of the shaft 22. The shaft 22 is further supported by a bearing 24 which is mounted between the shaft 22 and an annular bearing support extension 23 that extends from the engine block 16. The shaft 22 extends rearwardly out of the engine 10, terminating in a work-engaging coupler 25. The rearward end of the shaft 22 is supported by a plurality of legs 26 in a manner that will become clear from the further description contained hereinbelow.

Figure 3:
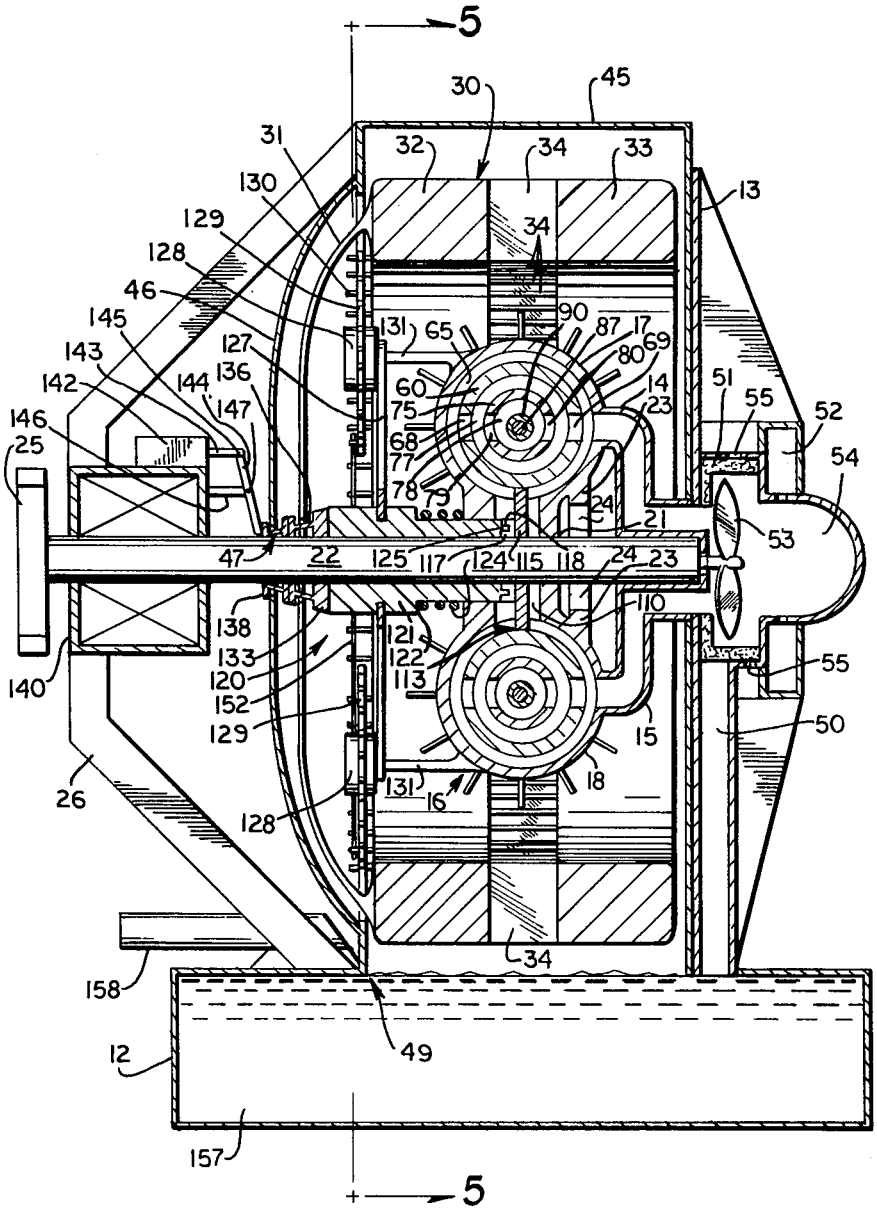
FIG. 3 is a side vertical cross sectional view of the engine of FIG. 1, taken along line 2—2 of FIG. 1.

As shown in FIGS. 2 and 3, the engine block 16 and cylinders 17 and 18 are surrounded by a rotor or flywheel 30. The rotor 30 is supported for rotational movement with the shaft 22 by a dish-shaped support plate 31 which is fixed at its periphery to the rotor 30 and fixed at its center to the shaft 22. The rotor comprises a pair of annular members 32 and 33 connected at the center of the rotor by a plurality of vanes 34. The vanes 34 are tilted from radial alignment with respect to the rotor 30 and allow the rotor to act as a turbine during operation of the engine 10.

As shown in FIG. 2, the ends of the cylinders 17 and 18 are enclosed by a pair of cylinder heads, a left cylinder head 36 enclosing the left end of the cylinders 17 and 18, and a right cylinder head 37 enclosing the right ends of the cylinders 17 and 18. The heads 36 and 37 are attached to the engine block 16 by bolts 38. The heads 36 and 37 define a plurality of exhaust conduits therein, which will be described in more detail hereinafter. The exhaust conduit from the right end of the upper cylinder 17 terminates in an exhaust opening 40 which directs exhaust from the upper cylinder 17 against the vanes 34 of the rotor 30. Similarly, exhaust openings 41, 42 and 43 direct exhaust from the right end of the lower cylinder 18, the left end of the upper cylinder 17 and the left end of the lower cylinder 18, respectively against the vanes 34.

A hood 45 encloses the engine block 16 and the rotor 30. The hood 45 is attached to the support member 13 at the front side of the engine block, and is also supported by the legs 26. At the rear side of the engine block 16, a dish-shaped cover 46 extends from the hood 45 to the drive shaft 22 where the cover 46 defines a cover shaft opening 47 in which the shaft 22 rotates. The opening 47 is close fitting about the shaft 22 to prevent escape of gases from within the hood enclosure 45. At the base 12, the hood 45 communicates with the hollow interior of the base 12 at an opening 49 for collection of exhaust gases in the base 12.

A recirculation duct 50 connects the interior of the base 12 to an air/fuel intake chamber 54 through an air filter 51. A mixture of fuel and outside air is metered into the chamber 54 by a conventional fuel vaporization and metering device 52, shown diagrammatically in FIG. 3. Additional outside air enters the chamber 54 through air intake openings 55 and through the filter 51.

A fan 53 rotates with the drive shaft 22 and pulls the vaporized air/fuel mixture from the chamber 54 through the intake manifolds 14 and 15 into the cylinders 17 and 18.

Figure 4:
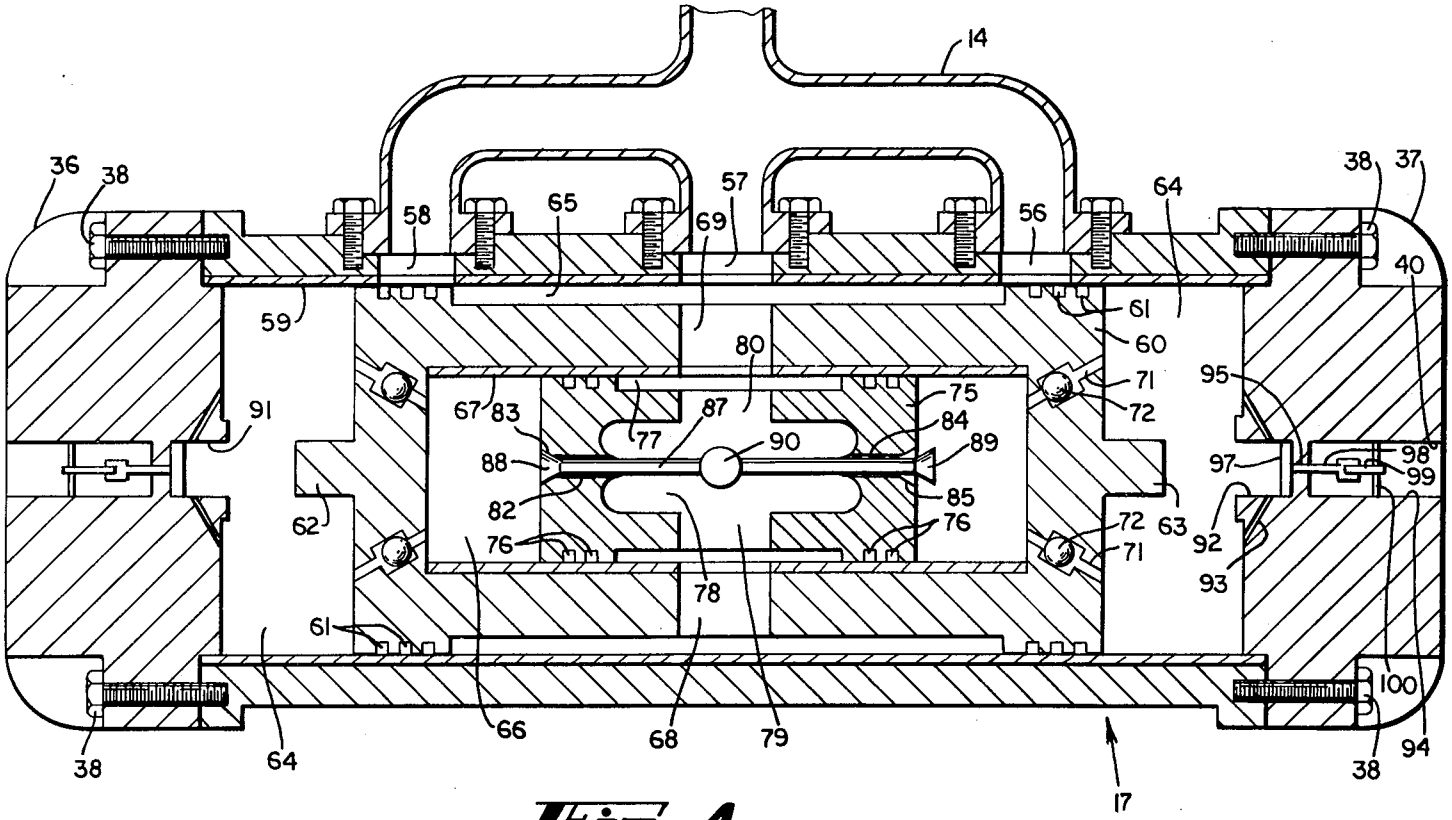
FIG. 4 is a horizontal cross sectional view of a piston assembly taken along line 4—4 of FIG. 2.

The internal structure of the cylinders 17 and 18 is best understood from FIG. 4, which is a horizontal cross sectional view of the upper cylinder 17, looking downwardly. As the internal structures are identical, only that of the upper cylinder 17 will be described. The intake manifold 14 divides at the cylinder 17 to communicate with the cylinder 17 through three side ports in the cylinder, a right port 56, a central port 57, and a left port 58. The cylindrical interior of the cylinder 17 provides a piston chamber 64 and includes a conventional liner 59 fixed to the interior walls of the cylinder 17. A cylindrical outer or primary double acting piston 60 is mounted for reciprocation within the piston chamber 64. The outer piston 60 includes a plurality of conventional rings 61 which slidably engage the liner 59. A rod-shaped plunger 62 extends integrally from the center of the left end of the piston 60 for a purpose that will become clear from the following description. A similar plunger 63 extends from the right end of the piston 60. The piston 60 also defines an annular channel 65 around the central portion of its circumference.

Within the outer piston 60 there is defined a cylindrical internal cavity 66 having a liner 67. The cavity 66 communicates with the annular channel 65 through a pair of side-opening passageways 68 and 69. The ends of the piston 60 also define a plurality of supplemental intake passageways 71 that connect the internal cavity 66 of the outer piston 60 with the piston chamber 64. In FIGS. 2 and 4, four of such passageways 71 are shown in the end of each piston. Each of the supplemental intake passageways 71 includes a check valve 72 that allows passage of gases through the passageway 71 only from the internal cavity 66 into the piston chamber 64.

An inner or secondary piston 75 is mounted within the internal cavity 66 of the outer or primary piston 60 for reciprocating movement along the internal cavity 66. A plurality of conventional piston rings 76 engage the liner 67. The inner piston 75 defines an annular channel 77 in the circumference thereof similar to the annular channel 65. The inner piston 75 also defines an internal cavity 78 which communicates with the annular channel 77 through side passageways 79 and 80.

At the left end of the internal piston 75, a bore 82 is defined connecting the internal cavity 78 with the internal cavity 66, and terminating in a valve seat 83 at the left end of the piston 75. A similar bore 84 and valve seat 85 connect the two internal cavities 78 and 66 at the right end of the internal piston 75. A dual valve rod 87 is slidably inserted through the colinear bores 82 and 84 so as to extend completely through the piston 75. The rod 87 includes a left valve end 88 that is selectively seated in the valve seat 83 and a right valve end 89 that is selectively seated in the valve seat 85. The rod 87 and valve ends 88 and 89 have a combined length slightly greater than the length of the inner piston 75, and the bores 82 and 84 are slightly larger in diameter than the rod 87. This permits passage of gases from the internal cavity 78 through the bores 82 or 84 into the internal cavity 66 through one of the ends of the piston 75 when the valve end 88 or 89 at that end of the piston is separated from its respective valve seat 83 or 85. The dual valve rod 87 can include a counterweight 90 at the center thereof to assist inertial movement of the rod 87. The function of the dual rod 87 in the operation of the engine 10 will be described in detail below.

Referring to FIGS. 2 and 4, the left head 36 defines a pocket 91 opening to the piston chamber 64 opposite the plunger 62. The pocket 91 is shaped to matingly receive the plunger 62 so that a cushion of compressed gases is created by the plunger 62 within the pocket 91 when the outer piston 60 moves to the extreme left of the cylinder 17. The head 37 defines a similar pocket 92 for matingly receiving the plunger 63 at the right end of the piston 60. Small pressure relief bores 93 can be drilled between the interior of the pockets 91 and 92 and the piston chamber 64 in order to prevent the pressure within the pockets from becoming too great and to allow the pressure to equalize when the piston 60 stops and reverses its direction of motion.

The heads 36 and 37 also define access openings 94 extending from the outside of the head 37 toward the piston chamber 64 and terminating a short distance from the innermost extent of the pocket 92. Since the mechanisms within the access openings 94 are identical for all four ends of the cylinders 17 and 18, only the right end of the upper cylinder 17 will be described in detail. The access opening 94 is connected to the pocket 92 by a small bore 95. A valve-actuating piston 97 is fitted within the pocket 92, and a piston rod 98 extends through the bore 95 and is attached to the piston 97. The piston rod 98 is pivotally connected to a rocker arm 99, as shown in FIGS. 2 and 4. The rocker arm 99 pivots about a rocker axle 100 so as to control an exhaust valve 106 which controls the exhaust from the piston chamber 64 of the cylinder 17 by selectively opening the piston chamber 64 to an exhaust conduit 105 which terminates in the exhaust opening 40 previously described. When the piston 60 moves to the left and begins to withdraw the plunger 63 from the pocket 92, the suction created draws the piston 97 into the pocket 92, pivoting the rocker arm 99 against the pressure of a spring 107 holding the valve 106 closed. The action of the rocker arm 99 opens the valve 106, allowing gases compressed by the piston 60 to escape through the exhaust conduit 105. Also found within the access opening 94 is a spark plug 109 that is inserted through the head 37 into the piston chamber 64. A conventional set of points (not shown) can be connected to the piston rod 98 so that the spark plug 109 is fired upon movement of the valve-actuating piston 97.

Figure 5:
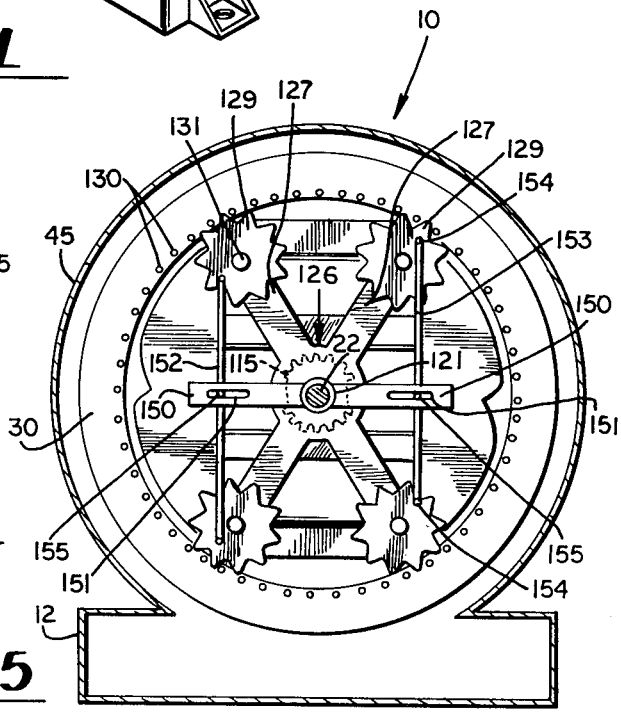
FIG. 5 is a rear plan view of an engine embodying the invention, taken along line 5—5 of FIG. 3 in order to remove covering and support structures to expose internal detail.

The central connecting portion 20 of the engine block 16 defines a disc-shaped opening 110 that is concentric with the drive shaft 22 and communicates at its upper and lower extremes with the cylinders 17 and 18. As shown in FIG. 2, the upper and lower outer pistons 60 each define a rack 112 in the surface of the annular channel 65 immediately opposite the opening 110. A pinion gear 115 is mounted for free rotation about the drive shaft 22, and the teeth 116 of the pinion gear 115 engage each of the rack members 112 of the outer pistons 60 simultaneously. It will thus be seen that the pinion gear interconnects the outer pistons 60 to synchronize their reciprocating movement, permitting only movement at equal speeds in opposite directions. As shown in FIG. 3, the pinion gear 115 includes an annular extension 117 surrounding the drive shaft 122 and including a plurality of sockets 118 opening toward the rear of the engine 10 for cooperation with a starting mechanism 120 that is best shown in FIG. 3 and FIG. 5.

The starter mechanism 120 includes an elongate collar 121 extending from the pinion gear 115 rearwardly to a point between the annular member 32 of the rotor 30 and the support plate 31 of the rotor. The forward portion of the collar 121 is separated from the rearward portion of the collar by a shoulder 122, and the forward portion of the collar is of a smaller diameter than the rearward portion. A plurality of pins 125 extend from the forward end of the collar toward the pinion gear 115, and are positioned to be received within the sockets 118 of the pinion gear 115. The collar 121 is slidably mounted about the drive shaft 22 which rotates within the collar 121. A normally extended coil spring 124 surrounds the forward portion of the collar 121 between the shoulder 122 and the engine block connecting portion 20. The spring 124 urges the collar 121 away from the pinion gear 115 so that the pins 125 are normally disengaged from the sockets 118. However, when the starting mechanism is operated, the collar is slid against the pressure of the spring 124 into the position shown in FIG. 3.

A cog wheel support assembly 126 is attached to the collar 121 adjacent to the rearward end thereof. Four support arms 127 of the assembly 126 extend from the collar 121 outwardly toward the rotor 30, as shown in FIG. 5. At the end of each support arm 127 a hub 128 is attached to the support arm 127. A cog wheel 129 is mounted for free rotation about the hub 128. In addition to being attached to a support arm 127, each hub 128 is slidably positioned along a guide rod 131 extending rearwardly from the engine block 16. The rotor 30 includes a plurality of pins 130 extending rearwardly from the inner edge of the annular member 32 of the rotor 30 in alignment with the teeth of the cog wheels 129. It will thus be seen that when the collar 121 moves forwardly into engagement with the pinion gear 15, the support arms 127 carry the cog wheels 129 into engagement with the pins 130. Furthermore, when the collar 121 moves rearwardly out of engagement with the pinion gear 115, the cog wheels 129 are carried rearwardly beyond the pins 130 so that the teeth of the cog wheels 129 do not engage the pins 130.

A linkage member 133 is mounted about the drive shaft 22 immediately adjacent and to the rear of the collar 121. The structure of the linkage 133 is shown in an exploded view of FIG. 6. The linkage 133 comprises a pair of annular members 134 and 135 joined together by a plurality of pins 136. The linkage 133 is assembled so that the annular members 134 and 135 loosely surround the drive shaft 122, and the pins 136 extend through mating openings in the support plate 31 of the rotor 30. As the rotor 30 rotates with the drive shaft 22, the linkage 132 also rotates with the shaft 22, but can be slidably moved axially along the shaft 22 relative to the cover 31 as well as to the shaft 22.

Figure 6:
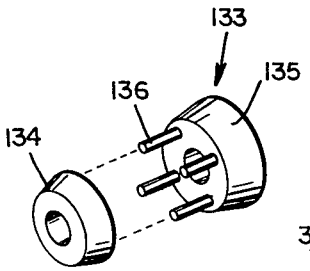
FIG. 6 is an exploded pictorial view of a linkage forming part of the starting mechanism of an engine embodying the invention.

A second linkage 138 constructed in a manner similar to that shown in FIG. 6 for the linkage 133 is mounted about the drive shaft 22 and passes through the cover 46. However, since the cover 46 does not rotate with the drive shaft 22, the second linkage 138 also remains in a fixed orientation, but is capable of sliding along the shaft 22 in a manner similar to that described for the linkage 133. Near the rearward end of the drive shaft 22, the shaft 22 passes through a starter motor 140 that is supported by the legs 26. The motor 140 is shown diagrammatically in FIG. 3. The armature (not shown) of the motor 140 is attached to the drive shaft 22 so that the motor 140 can be utilized in a conventional manner to rotate the drive shaft 22 during starting of the engine 10.

A solenoid 142 is mounted to the top of the motor 140, as shown in FIG. 1 and FIG. 3. Extending from the solenoid in the forward direction is a piston rod 143 which is pivotally connected to a downwardly extending lever arm 144 at a pivot 145. The lever arm also pivots about a point 147 defined at the end of an arm 146 extending from the housing of the motor 140. The lever arm 144 extends downwardly to a point adjacent to the drive shaft 22 where the arm 144 can engage the second linkage 138. When the piston rod 143 is withdrawn into the solenoid 142, the lever arm 144 urges the linkages 138 and 133, and the collar 121 forwardly. The electric starter motor 140 and the solenoid 142 are connected to power supplies in a conventional manner.

In addition to the cog wheel support assembly 126, the collar 121 also carries a pair of horizontally extending arms 150 which each include a horizontal slot 151 therein. The arms 150 are connected to the cog wheels 129 by means of two rods 152 and 153. Rod 152 is pivotally attached at its upper end to an eccentric point on the cog wheel 129 that is adjacent to the left end of the upper cylinder 17, and at its other end to a corresponding eccentric point on the cog wheel 129 that is mounted adjacent to the left end of the lower cylinder 18. A connector 155 is rigidly fixed to the center of the rod 152 and slidably engages the slot 151 of the arm 150 extending to the left of the collar 121. Correspondingly, the rod 153 is eccentrically and pivotally attached to eccentric points on the cog wheels mounted adjacent to the right ends of the cylinders 17 and 18 and is slidably connected to the slot 151 of the arm 150 extending to the right of the collar 121. It will be seen that as a result of the eccentric mounting of the ends of the rods 152 and 153, rotation of the cog wheels in a uniform direction will cause the rods to move up and down and thereby cause the arms 150 to rock up and down about the axis of the drive shaft 22.

Treatment of exhaust gases is accomplished by passing the exhaust through a fluid contained in the hollow interior of the base 12. The fluid 157 preferably comprises a mixture of nine parts water to one part soluble oil. Such solution will wash the exhaust gases as they pass through the fluid 157 and prior to escaping into the atmosphere through exhaust manifolds 158. If desired, a plurality of baffles (not shown) may be constructed within the base 12 to lengthen the path of exhaust gases entering the base 12 from the hood 45 through the opening 49, prior to reaching the exhaust manifolds 158.

OPERATION

In order to start the engine 10, the solenoid 142 is first energized to draw the piston rod 143 into the solenoid 142. This causes the lever arm 144 to exert a lateral force against the linkage 138, which in turn exerts a lateral force on the linkage 133, which in turn urges the collar 121 forwardly against the pressure of the spring 124. The cog wheels 129 are carried with the collar 121 forwardly until the teeth of the cog wheels 129 are in the same plane as the pins 130 extending from the side of the rotor 30. Also, the pins 125 at the forward end of the collar 121 enter the sockets 118 in the pinion gear 115. At this time, the starter motor 140 is energized, and the drive shaft 122 is thereby rotated. The rotation of the drive shaft 22 causes rotation of the rotor 30, and it will be seen that the pins 130 moving past the teeth of the cog wheels 129, cause the cog wheels to rotate in a uniform direction. The rotation of the cog wheels carries the eccentric points of attachment of the rods 152 and 153 in alternating up and down movement, and the movement of the rods 152 and 153 causes the arms 150 connected to the collar 121 to rotate alternately back and forth through an arc, because of the relative locations of the eccentric pivot points to which the rods 152 and 153 are attached. Since the arms 150 are attached to the collar 121, the collar is also rotated back and forth through the same arc. It should be noted that the rotation of the shaft 22 is independent of the motion of the arms 150 and collar 121.

Since the pins 125 of the collar 121 are inserted into the sockets 118 of the pinion gear 115, the pinion gear 115 also moves alternately through the same arc as the collar 121. Therefore, the motion of the pinion gear 115 is transmitted to the rack members 112 on the outer pistons 60, so that as the pinion gear moves through the arc in a counterclockwise direction, as viewed in FIG. 2, the upper piston will move to the left and the lower piston will move to the right. When the pinion gear 115 moves through the arc in a clockwise direction, the upper piston will move to the right and the lower piston will move to the left. Thus, the engagement of the starting mechanism 120 causes reciprocation of the pistons within the cylinders 17 and 18. This reciprocation will include entry of the plungers 62 and 63 into the pockets 91 and 92. The rotation of the drive shaft 22 rotates the fan 53, which draws the vaporized air/fuel mixture from the metering device 52 through the intake manifolds 14 and 15 and into the piston chamber 64. The mixture is compressed at alternate ends of the pistons by their motion caused by the pinion gear 115. When the pinion gear begins to remove one of the plungers 62 or 63 from the pockets 91 or 92, such movement is sensed by the valve-actuating piston 97, causing the spark plug 109 to fire and the exhaust valve 106 to open. Because the movement of the pistons in the upper and lower cylinders is coordinated by the pinion gear 115, this will happen simultaneously at opposite ends of the two pistons. The firing of the spark plugs 109 will cause motion of the pistons by the force of the exploding fuel. When the engine begins firing normally, the starting motor is no longer needed, and can be deenergized. Furthermore, the solenoid is deactivated so that the piston rod 143 moves outwardly from the solenoid 142, and the spring 124 urges the starting assembly 120 rearwardly, disengaging the collar 121 from the pinion gear 115 and disengaging the cog wheels 129 from the pins 130 on the rotor.

The continuing operation of the engine 10 after starting the engine will be described first with particular reference to FIG. 4. It will be noted that as the outer or primary piston 60 moves to the left in FIG. 4, the vaporized air/fuel mixture moves through the intake manifold 14 into the piston chamber 64 through the port 56 once the right end of the piston 60 has cleared the port 56. At the same time, the air/fuel mixture passes through the ports 57 and 58 into the annular channel 65 in the outer surface of the piston 60, and passes from the annular channel 65 through both of the side openings 68 and 69 into the annular channel 77 of the inner or secondary piston 75. From the annular channel 77, the air/fuel mixture moves into the internal cavity 78 of the inner piston 75 through the side openings 79 and 80. When the outer piston 60 begins to slow due to compression of gases at the left end of the piston 60, the inner piston 75 begins to move to the left within the internal cavity 66 of the outer piston 60. When this occurs, inertial forces cause the valve end 88 of the valve rod 87 to seat within the valve seat 83 at the left end of the inner piston 75. This causes the valve end 89 at the opposite end of the rod 87 to move out of the valve seat 85, so that the air/fuel mixture in the internal cavity 78 of the inner piston 75 escapes through the bore 84 into the internal cavity 66 of the outer piston 60 at the right end of the inner piston 75.

When the outer piston 60 beings to move to the right in FIG. 4 following an explosion of fuel at the left end of the piston 60, the right end of the outer piston 60 passes the port 56 and begins to compress the air/fuel mixture within the confined portion of the piston chamber 64 at the right end of the piston 60. As the piston 60 continues to move to the right, the plunger 63 extending from the piston enters the pocket 92 in the head 37. Pressure quickly builds up in the pocket 92, preventing by a cushioning action a hard impact of the piston 60 against the head 37. The build-up of pressure in the pocket 92 and in the piston chamber 64 causes the piston 60 to slow in its movement, and therefore the inner piston 75 that has been carried along with the outer piston 60 beings to move to the right within the outer piston 60. Inertial action causes the bore 84 to be closed by the valve end 89, so that the air/fuel mixture that was earlier admitted into the internal cavity 66 to the right of the inner piston 75 begins to be compressed. This compressed air/fuel mixture in the internal cavity 66 passes slowly through the passageways 71 to supplement the air/fuel mixture in the piston chamber 64.

As soon as the outer piston 60 begins to rebound from the head 37, the withdrawing plunger 63 will create suction acting on the piston 97 within the pocket 92. The size of the pressure relief bores 93 is selected so that rapid movement of the plunger 63 within the pocket 92 will create pressure or suction, but the pressure built up by the plunger 63 will equalize as the piston 60 reverses direction at the end of a stroke. Thus, the withdrawal of the plunger will create suction within the pocket 92. In response to movement of the piston 97, the spark plug 109 is fired and the exhaust valve 106 is opened. The explosion of the air/fuel mixture caused by the firing of the spark plug 109 causes the outer piston 60 to move back in the leftward direction and also causes a high pressure stream of exhaust gases to flow through the conduit 105 out of the exhaust opening 40 and into contact with the vanes 34 of the rotor 30. It will be seen according to the orientation of the exhaust openings in the vanes shown in FIG. 2 that the rotor will be moved in a clockwise direction as seen in FIG. 2 by the impinging exhaust gases. After passing across the vanes 34, the exhaust gases are collected within the hood 45. Such exhaust gases pass around the rotor to the fluid 157 within the base 12. A portion of the treated exhaust gases is recirculated through the recirculation duct 50, and another portion of the treated exhaust gases escapes into the atmosphere through the exhaust manifolds 158.

During the burning of the air/fuel mixture after the firing of the spark plug 109, additional air/fuel mixture continues to enter the piston chamber 64 through the supplemental intake passageways 71. This provides a more even and extended burn and results in greater fuel efficiency.

It will be understood that the sequence just described will be repeated at the left end of the piston chamber 64, and therefore identical elements are provided in the left head 36 and will not be described in further detail. Furthermore, the same elements are provided in the heads 36 and 37 at the two ends of the piston within the lower cylinder 18.

The pinion gear 115 continues to move alternately back and forth through an arc about the axis of the drive shaft 22 as the pistons 60 reciprocate and the drive shaft 22 rotates within the pinion gear. Since the pinion gear engages the rack member 112 of each of the outer pistons, the pinion gear synchronizes the movement of the pistons, requiring such movement to be in opposite directions at equal speeds. Thus, the ignition of the air/fuel mixture at the right end of the piston within the upper cylinder 17 occurs simultaneously with the firing of the spark plug at the left end of the piston within the lower cylinder 18. Thereafter, when the pistons have moved across their respective cylinders, the spark plug at the left end of the piston within the upper cylinder 17 will fire simultaneously with the spark plug at the right end of the piston within the lower cylinder 18. In this manner, the vanes 34 of the rotor 30 will be impinged by exhaust gases alternately from the exhaust openings 40 and 43 and then 41 and 42. The rapid reciprocation of the pistons generates a strong flow of exhaust gases which rotate the rotor 30 in a powerful and rapid manner. The rotation of the rotor 30 causes rotation of the drive shaft 22 which may be connected to do work through the coupling 25. The cog wheels 129 and collar 121 of the starter mechanism are idle during the normal operation of the engine 10. It will be seen that the linkage 133 rotates with the shaft 22 and support plate 31.

It should be understood that a cooling system (not shown) can be provided for the internal combustion engine 10. A stream of coolant liquid can be directed against the exhaust conduits 105 along their length. Vaporization of the coolant liquid upon contact with the exhaust conduits 105 provides additional expanding gases for driving the rotor 30. All electrical ports, such as the spark plugs, would be waterproofed.

In a second embodiment of the invention (not shown), three pistons are formed by the engine block within the rotor. The three pistons are vertically aligned with their longitudinal axes in the same vertical plane. The three pistons are interconnected by means of two pinion gears similar to the gear 115, so that the upper and lower pistons move in unison while the central piston moves in the opposite direction. In order to maintain dynamic balance, the central piston has a displacement twice that of each of the upper and lower pistons. The structure of the double acting pistons in the second embodiment, as well as their operation, is identical to that described for the first embodiment of the invention.

In connection with either of the embodiments described above, an alternate timing means for firing the spark plugs and opening the exhaust valves can be provided. The alternate movement of the pinion gear 15 through an arc provides a cam-like motion that can be utilized to operate the rocker arm 99 which opens and closes the valve 106. In particular, a push rod can be connected to an appropriate point on the pinion gear 115 so as to operate the rocker arm 99 and open the valve 106 when the pinion gear 115 has reached a position corresponding to the ignition of exhaust gases in the piston chamber at the end of the piston 60. When this alternate mechanism is used, the spark plug 109 can be fired using a conventional timing mechanism, for example, of the type used in standard automobile engines.

It will thus be seen that an internal combustion engine embodying the present invention provides a novel and improved turbine-drive engine using a novel arrangement of double-acting pistons to compress fuel for ignition to drive the turbine. The engine according to the present invention has been designed to reduce fuel consumption by increasing efficiency and recycling unburned fuel. Means is provided for washing harmful fumes from the exhaust gases, and the vanes of the rotor 34 act as a muffler to decrease noise pollution.

While this invention has been described in detail with reference to particular embodiments thereof, it will be understood that variations and modifications can be effected within the spirit and scope of the invention as described hereinbefore and as defined in the appended claims.

I claim:

1. A reciprocating piston apparatus for an internal combustion engine, comprising:

a housing defining a cylindrical piston chamber and having a first end and a second end, said housing defining through the cylindrical wall thereof a first vaporized fuel opening adjacent to said first end of said housing, and a second vaporized fuel opening adjacent to said second end of said housing;

an outer cylindrical piston having a first end and a second end, fitted within said housing for reciprocal movement, said outer piston defining a first annular channel in the cylindrical surface thereof, a first interior cylindrical cavity therein, and a first passageway connecting said first annular channel and said first interior cavity;

an inner cylindrical piston fitted within said interior cavity of said outer piston for reciprocal movement, said inner piston defining a second interior cavity therein, a second annular channel in the cylindrical surface thereof, a second passageway connecting said second annular channel to said second interior cavity and first valve means for alternately providing a passageway between said second interior cavity and said first interior cavity of said outer piston at alternate ends of said inner piston;

said first end of said outer piston defining a third passageway therein between said first interior cavity of said outer piston and said piston chamber adjacent to said first end of said housing, said third passageway including second valve means for permitting passage of vaporized fuel therethrough only toward said piston chamber;

said second end of said outer piston defining a fourth passageway therein between said first interior cavity of said outer piston and said piston chamber adjacent to said second end of said housing, said fourth passageway including third valve means for permitting passage of vaporized fuel therethrough only toward said piston chamber;

said first end of said housing defining a first exhaust opening therein including fourth valve means for selectively opening and closing said first exhaust opening;

said second end of said housing defining a second exhaust opening therein including fifth valve means for selectively opening and closing said second exhaust opening;

first ignition means for selectively igniting vaporized fuel between said first end of said outer piston and said first end of said housing; and second ignition means for selectively igniting vaporized fuel between said second end of said outer piston and said second end of said housing;

said first vaporized fuel opening in said housing communicating with said piston chamber between said first end of said outer piston and said first end of said housing, and said second vaporized fuel opening communicating with said first annular channel in said outer piston, when said outer piston moves toward said second end of said housing;

said second vaporized fuel opening communicating with said piston chamber between said second end of said outer piston and said second end of said housing, and said first vaporized fuel opening communicating with said first annular channel in said outer piston, when said outer piston moves toward said first end of said housing;

and said first passageway defined by said outer piston communicating with said second annular channel of said inner piston.

2. The apparatus of claim 1 further comprising:

a first pocket extending from said piston chamber into said first end of said housing;

a first piston extension extending from said first end of said outer piston, said first piston extension entering said first pocket in close fitting relationship thereto when said outer piston moves toward said first end of said housing;

a second pocket extending from said piston chamber into said second end of said housing; and a second piston extension extending from said second end of said outer piston, said second piston extension entering said second pocket in close fitting relationship thereto when said outer piston moves toward said second end of said housing.

3. The apparatus of claim 1 further comprising a third vaporized fuel opening in the cylindrical wall of said housing between said first and second vaporized fuel openings.

4. The apparatus of claim 2 further comprising means responsive to a decrease in the pressure within said first and second pockets for operating said fourth and fifth valve means, respectively, to open said first and second exhaust openings, respectively.

* * * * *